United States Patent [19]

Wasson

[11] 4,325,187

[45] Apr. 20, 1982

[54] SWIVEL SPOON FEEDING DEVICE

[76] Inventor: Phyllis E. Wasson, 12814 Prestwick Dr., Oxon Hill, Md. 20022

[21] Appl. No.: 108,650

[22] Filed: Dec. 31, 1979

[51] Int. Cl.[3] ..... A47J 43/28

[52] U.S. Cl. ..... 30/327; 30/298

[58] Field of Search ..... 30/142, 324, 298, 327, 30/232, 291

[56] References Cited

U.S. PATENT DOCUMENTS

| | | | |
|---|---|---|---|
| 659,341 | 10/1900 | Dodd | 30/324 |
| 853,979 | 5/1907 | Karrer | 30/232 |
| 3,553,819 | 1/1971 | Johnson | 30/232 X |
| 3,834,021 | 9/1974 | White | 30/232 |

*Primary Examiner*—Jimmy C. Peters

[57] ABSTRACT

A swivel spoon feeding device adapted to be used by persons exhibiting tremors and/or poor grasp. The device includes a spoon or other feeding utensil adapted to swivel. A feeding portion is mounted on a support or handle member which in turn is attached to the user's hand by a velcro cuff. This means of mounting the utensil on the support or handle in addition to the velcro cuff would allow for a secure grip, and enable the users to feed themselves without a large portion of the food falling off the feeding portion of the utensil.

4 Claims, 5 Drawing Figures

SWIVEL SPOON FEEDING DEVICE

BACKGROUND OF THE INVENTION

The prior art is replete with devices containing a rotatable, self-leveling spoon bowl which is rotatably attached to a spoon handle. However, all of these devices are adapted to be used in the teaching of infants or young children to feed themselves. These devices are designed to teach children to hold the handle of the spoon so that the bowl of the spoon is level and food thereon is not spilled over the side of the bowl while they are eating. However, while these spoons are designed to allow the bowl to remain level, an assumption is made that the children's grip is sufficient to adequately grasp the handle of the spoon. Representative of these devices are U.S. Pat. Nos. 2,505,122; 2,636,266; 2,741,027 and 2,809,426. All of these patents relate to feeding implements for infants so that the bowl of the spoon remains level. None of these devices, however, address themselves to the situation prevalant in older persons having senile tremors or people afflicted with cerebral palsy, multiple sclerosis or the like. These people do not have a strong enough grasp for them to utilize devices described the above-cited patents. Additionally, these people exhibit hand tremors which would also make the use of these devices ineffectual.

SUMMARY OF THE INVENTION

The present invention overcomes the disadvantages of the prior art by providing a spoon or other utensil which can be utilized by persons exhibiting hand tremors or having a very poor grip. The device includes a swivel spoon having a cylindrical member. A groove present in the cylindrical member allows the spoon to swivel. Attached to a second groove running the length of the cylindrical member is an elongated handle consisting of a flat metal bar connected to a leather cover. An eyeglass-like member is attached to the handle member and consists of two loops adapted to allow the users fingers to be inserted therein. A velcro cuff is fastened around the users hand and handle means to allow for a secure grip.

BRIEF DESCRIPTION OF THE DRAWINGS

The invention will be described in more detail below in conjunction with the accompanying drawings in which.

DETAILED DESCRIPTION OF THE DRAWINGS

Figure 1:
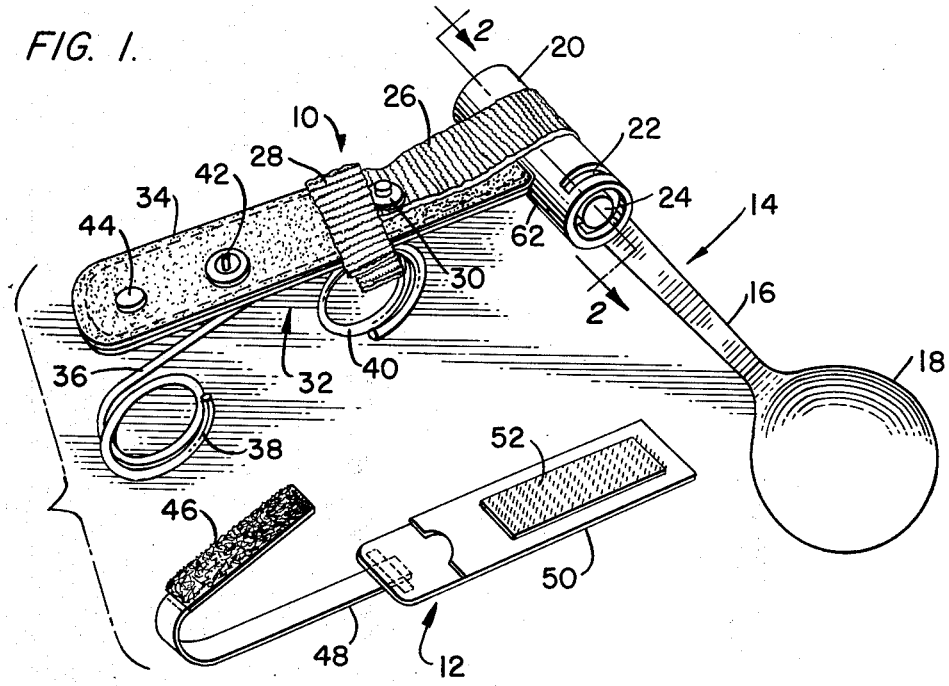
FIG. 1 is a perspective view of the swivel utensil.
Figure 2:
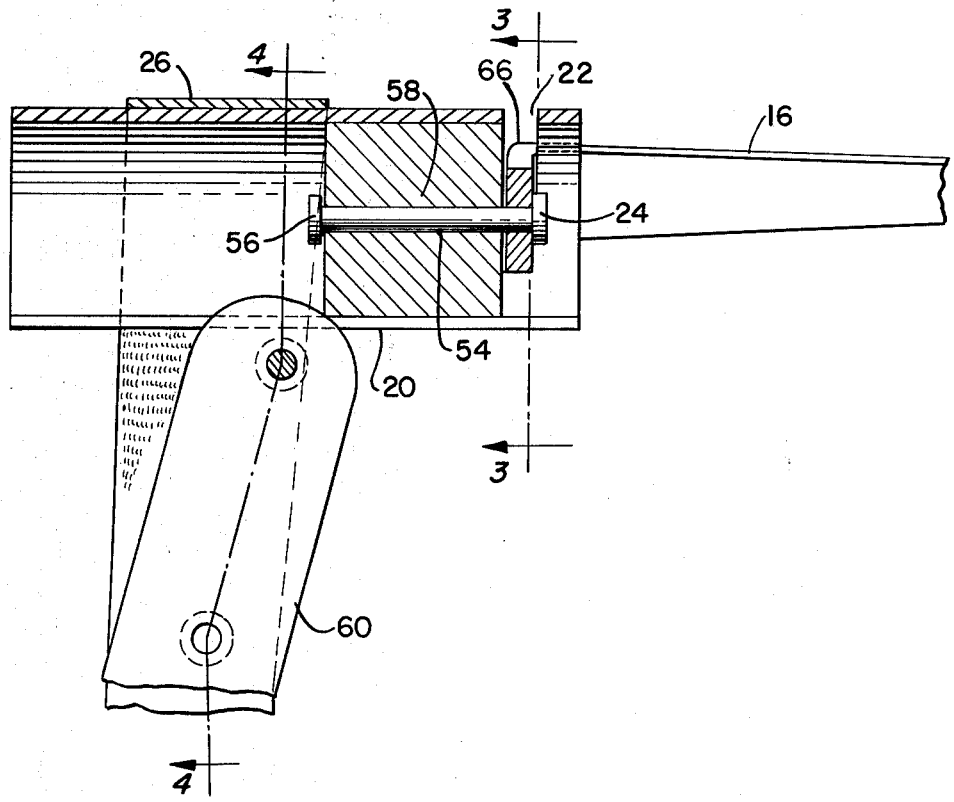
FIG. 2 is a cross-sectional view through lines 2—2 of FIG. 1.

As shown in FIG. 1, the swivel spoon feeding device consists of a feeding portion 10 and a retaining cuff 12 allowing the feeding portion to be retained on the users hand. The feeding portion 10 consists of a utensil 14 having a handle 16 and a ladle 18. Although the utensil utilized for feeding the patient has been described as a spoon in the drawing, it can be appreciated that a feeding utensil such as a fork could also be utilized. The handle 16 is attached to a cylindrical holding member 20 by a swivel screw 54 containing heads 24 and 56 as shown in FIG. 2. A groove 22 extends around and through the cylindrical holder 20 for approximately 270°. The end of the handle 16 is bent approximately 90° with respect to the main portion as shown by 66. This end fits into groove 22 and is attached to the cylindrical holding member allowing the utensil to swivel if the patient's hand should tremble or otherwise move during feeding.

The cylindrical holding member 20 is attached to a handle portion 32 by a cloth retainer 26. Although this cloth retainer is shown in the drawing, any other suitable retaining means could also be utilized. The handle portion 32 consists of a leather band 34 attached to a metal base member 60 (see FIG. 2). Additionally, a finger holder 36 containing finger holes 38 and 40 is also attached to the metal base member 60. A rivet 30 is used to attach the cloth retainer 26 to the leather handle 34 and the metal base member 60, and a rivet 44 is also used to attach the leather handle 34 to the metal base member 60. Additionally, the finger holder 36 is attached to both the leather handle 34 and the metal base member 36 by a screw 42. A velcro cuff 28 surrounds a portion of the finger holder 36 and the leather handle 34 to anchor the finger holder more securely.

Figure 5:
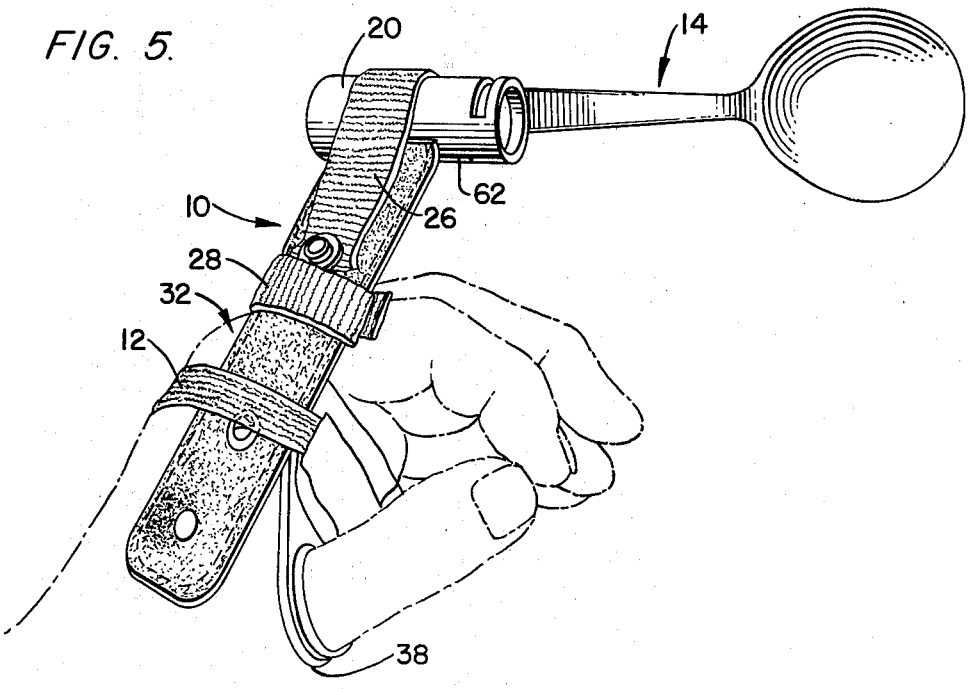
FIG. 5 is a perspective view of the swivel utensil in use.

The cuff retaining member 12 is to be attached around the hand of the patient and the swivel spoon for maintaining provide further stabilization for the patient's hand during feeding as shown in FIG. 5. The cuff contains a body portion 50 and an elastic band 48, allowing a velcro loop 46 to be attached to a velcro hook 52.

FIG. 2 is a cross-sectional view of the swivel spoon and in more detail shows the swivel connection between the handle 16 of the feeding utensil and the cylindrical holding member 20. The end of the handle 66 is bent approximately 90° with respect to the main portion of the handle 16. This bent portion 52 is inserted into the groove 22 and is retained therein by a swivel screw 54, allowing the bent end 52 to move within the slit 22. The cylindrical block 58 is retained within the cylindrical holder 20 and between the swivel screw heads 24 and 56 as well as the bent end 66 of the handle 16. Since the screw 54 is allowed to rotate within the block 58, the bent end 66 and consequently the entire utensil 14 is also allowed to move.

Figure 3:
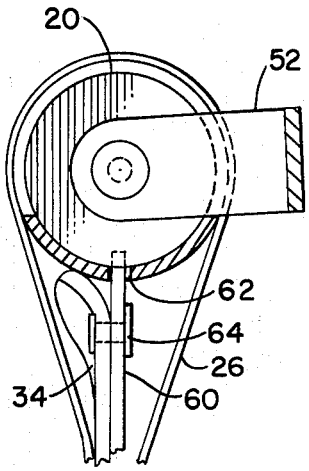
FIG. 3 is a vertical cross sectional view through lines 3—3 of FIG. 2.

As shown in FIG. 3, a second groove 62 is provided in the cylindrical holder 20 and extends for its entire length. The metal base member 60 is inserted into this groove and is retained therein by forcing it against the block member 58 and by the force of the cloth retainer 26. Additionally, a rivet 64 is provided between the metal base member 60 and the leather holder 34 to also provide stabilization.

Figure 4:
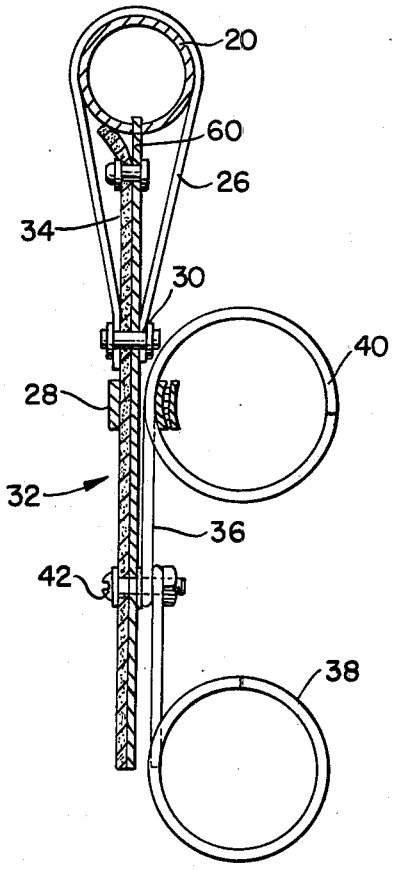
FIG. 4 is a vertical cross-section through lines 4—4 of FIG. 2.

FIG. 4 shows the connections between the cylindrical holder 20 and the handle 32. As shown, the metal base member 60 is inserted into a slit in the cylindrical holder 20. The cloth retainer 26 affixes the cylindrical holder 20 to the metal base member 60 and the leather strap 34, in conjunction with the rivet 30. A standard velcro retainer encircles the leather handle 34. the metal base member 60, in addition to one of the finger holders 40. A screw and nut combination 42 allows the finger holder 36 to be affixed to both the leather strap 34 as well as the metal base member 60.

FIG. 5 shows the swivel spoon feeding device in use. As shown, the left forefinger of the user is inserted through the finger hole 40 and the left thumb of the user is inserted through finger hole 38. The velcro cuff 12 is then attached so that it encircles the palm of the patient as well as the handle 32. In this manner, the user is able to place some food in the ladle 18 of the spoon and then bring the spoon to his mouth without a large portion of the food falling from the ladle 18. If the user's hand trembles, the spoon will swivel within slot 22 and thereby allowing the ladle portion of the spoon not to overturn. Although FIG. 5 shows the use of a user's left hand, it can be appreciated that the device is also suitable for use by the right hand of the user.

While the invention has been illustrated and described in detail in the drawings and foregoing description, the same is to be considered as illustrative and not restrictive in character. it being understood that only the preferred embodiment has been shown and described and that all changes and modifications that come within the spirit of the invention are desired to be protected.

We claim:

1. A swivel utensil feeding device comprising:

a handle adapted to be grasped by the hand of a user;

a support attached to one end of said handle;

a food holding portion, said food holding portion containing a means for holding the food and an elongated member swivelly attached to the end of said support; and means for encircling the hand of the user and said handle, for maintaining the utensil within the user's grasp.

2. A swivel utensil as claimed in claim 1 wherein said handle means includes a pair of finger holes for the insertion of the user's fingers therein.

3. A swivel utensil in accordance with claim 1 wherein said support contains a cylindrical member having a slot proximate to the edge of said cylindrical member, said elongated member of said food holding portion containing an end bent with respect to said food holding portion for engagement with said slot and a means positioned in said cylindrical housing for swivelly holding said bent portion in said slot.

4. A swivel utensil as claimed in claims 2 or 3 wherein said means for encircling the user's hand includes a velcro cuff.

* * * * *